US011633825B2

(12) United States Patent
Hykes

(10) Patent No.: US 11,633,825 B2
(45) Date of Patent: Apr. 25, 2023

(54) ACOUSTIC CRANKPIN LOCATION DETECTION

(71) Applicant: Fives Landis Corp., Hagerstown, MD (US)

(72) Inventor: Timothy W. Hykes, Greencastle, PA (US)

(73) Assignee: FIVES LANDIS CORP., Hagerstown, MD (US)

( * ) Notice: Subject to any disclaimer, the term of this patent is extended or adjusted under 35 U.S.C. 154(b) by 479 days.

(21) Appl. No.: 16/783,723

(22) Filed: Feb. 6, 2020

(65) Prior Publication Data

US 2021/0245320 A1 Aug. 12, 2021

(51) Int. Cl.
*B24B 5/42* (2006.01)
*B24B 49/00* (2012.01)

(52) U.S. Cl.
CPC ..... *B24B 5/42* (2013.01); *B24B 49/003* (2013.01)

(58) Field of Classification Search
CPC .. B24B 5/04; B24B 5/42; B24B 5/423; B24B 9/04; B24B 23/02; B24B 19/12;
(Continued)

(56) References Cited

U.S. PATENT DOCUMENTS 4,384,333 A 5/1983 Maecker
4,821,460 A 4/1989 Wegmann
(Continued)

FOREIGN PATENT DOCUMENTS

EP 1235662 B1 6/2004
JP 2005335036 A * 12/2005
(Continued)

OTHER PUBLICATIONS

Machine translation of JP-2005335036-A (Year: 2005).*
(Continued)

*Primary Examiner* — Orlando E Aviles
*Assistant Examiner* — Robert F Neibaur
(74) *Attorney, Agent, or Firm* — Reising Ethington P.C.

(57) ABSTRACT

A grinding machine including one or more grinding wheels has a workpiece holder that releasably holds a crankshaft and is configured to rotate the crankshaft about a longitudinal axis; a spindle assembly, that is moveable in at least two directions, including a spindle shaft and a grinding wheel attached to the spindle shaft; and an acoustic emission sensor coupled to the grinding machine, such that the grinding machine is configured to monitor an output signal from the acoustic emission sensor, move the grinding wheel into contact with the crankshaft at a first angular position, detect contact between the grinding wheel and the crankshaft based on the output signal, determine a position of the grinding wheel based on the detected contact between the grinding wheel and the crankshaft, move the grinding wheel away from the crankshaft, rotate the crankshaft a defined angular amount, move the grinding wheel into contact with the crankshaft at a second angular position, determine a position of the grinding wheel based on the detected contact between the grinding wheel and the crankshaft, and determine a position of a crankshaft surface.

14 Claims, 6 Drawing Sheets

(58) Field of Classification Search

CPC ..... B24B 19/125; B24B 41/01; B24B 49/00; B24B 49/003; B24B 49/04; B24B 53/005; B24B 53/053; B24B 53/06; B24B 53/062; B24B 53/07; B24B 53/095; B24B 53/12; B24D 3/06; B24D 5/02; B24D 5/12; B24D 5/16

USPC ..... 451/5, 11, 12, 36, 49, 51, 56, 178, 451/212.213, 218, 221, 242, 342, 451/358.385, 387, 398, 399, 443, 460, 451/541

See application file for complete search history.

(56) References Cited

U.S. PATENT DOCUMENTS

| | | | | |
|---|---|---|---|---|
| 5,647,788 | A | 7/1997 | McHugh et al. | |
| 5,691,909 | A | 11/1997 | Frey et al. | |
| 5,919,081 | A * | 7/1999 | Hykes | B24B 5/42 451/8 |
| 6,645,047 | B1 * | 11/2003 | Liskow | B24B 49/10 451/9 |
| 7,016,799 | B2 | 3/2006 | Dondi | |
| 7,047,658 | B2 | 5/2006 | Danielli et al. | |
| 7,056,189 | B2 | 6/2006 | Yui et al. | |
| 7,607,239 | B2 | 10/2009 | Dall'Aglio et al. | |
| 7,787,982 | B2 | 8/2010 | Meki | |
| 7,815,493 | B2 * | 10/2010 | Pflager | B24B 47/26 451/450 |
| 8,172,644 | B2 | 5/2012 | Mizutani et al. | |
| 8,920,211 | B2 * | 12/2014 | Wakazono | B24B 53/14 451/21 |
| 10,322,486 | B2 * | 6/2019 | Nagaya | B24B 49/08 |
| 10,486,288 | B2 * | 11/2019 | Watanabe | B24B 5/00 |
| 11,117,240 | B2 * | 9/2021 | Watanabe | B24B 49/003 |
| 2005/0208878 | A1 | 9/2005 | Weiss | |
| 2006/0111020 | A1 | 5/2006 | Claussen-Markefka | |
| 2009/0203296 | A1 * | 8/2009 | Braig | B24B 53/005 451/72 |
| 2009/0258576 | A1 | 10/2009 | Mizutani et al. | |
| 2015/0133034 | A1 | 5/2015 | Luthi et al. | |
| 2018/0311789 | A1 | 11/2018 | Barbosa de Oliveira Ferreira Salles et al. | |

FOREIGN PATENT DOCUMENTS

| | | | |
|---|---|---|---|
| JP | 2008279542 | A * | 11/2008 |
| WO | WO2017025739 | A1 | 2/2017 |

OTHER PUBLICATIONS

Machine translation of JP-2008279542-A (Year: 2008).*

International Search Report for International Application No. PCT/US2020/016996 dated Oct. 15, 2020 (3 pages).

Written Opinion for International Application No. PCT/US2020/016996 dated Oct. 15, 2020 (7 pages).

International Preliminary Report on Patentability for International Application No. PCT/US2020/016996 dated Jul. 28, 2022 (8 pages).

* cited by examiner

ACOUSTIC CRANKPIN LOCATION DETECTION

TECHNICAL FIELD

The present application relates to machine tools and, more particularly, grinding machines.

BACKGROUND

Grinding machines can be used to machine or grind elongated workpieces. The elongated workpiece can be held at a head and a tail and rotated so that one or more grinding wheels contact an outer surface of the workpiece and shape that surface by removing material. Elongated workpieces may be crankshafts that are used in internal combustion engines (ICEs) or pumps. The journal surfaces and crankpin surfaces of a crankshaft are carefully ground so that the surfaces have very precise sizes and shapes. A grinding machine can locate a surface of an elongated workpiece by physically contacting the surface with a dedicated probe and, when contact is made, the machine can determine where the surface is located. However, it is possible to increase the precision with which the surface is located and/or measured.

SUMMARY

In one implementation, a grinding machine including one or more grinding wheels has a workpiece holder that releasably holds a crankshaft and is configured to rotate the crankshaft about a longitudinal axis; a spindle assembly, that is moveable in at least two directions, including a spindle shaft and a grinding wheel attached to the spindle shaft; and an acoustic emission sensor coupled to the grinding machine, such that the grinding machine is configured to monitor an output signal from the acoustic emission sensor, move the grinding wheel into contact with the crankshaft at a first angular position, detect contact between the grinding wheel and the crankshaft based on the output signal, determine a position of the grinding wheel based on the detected contact between the grinding wheel and the crankshaft, move the grinding wheel away from the crankshaft, rotate the crankshaft a defined angular amount, move the grinding wheel into contact with the crankshaft at a second angular position, determine a position of the grinding wheel based on the detected contact between the grinding wheel and the crankshaft, and determine a position of a crankshaft surface.

In another implementation, a method of determining a grinding wheel position includes determining an angular position of a crankshaft held by a workpiece holder; moving a grinding wheel coupled with a spindle shaft toward the crankshaft; monitoring an acoustic emission sensor as the grinding wheel moves toward the crankshaft before grinding begins; detecting when the grinding wheel contacts the crankshaft based on output from the acoustic emission sensor; moving the grinding wheel away from the crankshaft; rotating the workpiece a defined angular amount to a second angular position; moving the grinding wheel toward the crankshaft at the second angular position; monitoring the acoustic emission sensor as the grinding wheel moves toward the crankshaft at the second angular position before grinding begins; detecting when the grinding wheel contacts the crankshaft at the second angular position based on output from the acoustic emission sensor; determining a position of the grinding wheel.

In another implementation, a grinding machine includes one or more grinding wheels and a workpiece holder that releasably holds a crankshaft and is configured to rotate the crankshaft about a longitudinal axis; a spindle assembly, that is moveable in at least two directions, including a spindle shaft and a grinding wheel attached to the spindle shaft; and a microprocessor configured to measure electrical power consumed by a spindle motor, wherein the grinding machine moves the grinding wheel into contact with the crankshaft at a first angular position, detects contact between the grinding wheel and the crankshaft based on a change in the electrical power consumed by the spindle motor, determines a position of the grinding wheel based on the detected contact between the grinding wheel and the crankshaft, moves the grinding wheel away from the crankshaft, rotates the crankshaft a defined angular amount, moves the grinding wheel into contact with the crankshaft at a second angular position, determines a position of the grinding wheel based on the detected contact between the grinding wheel and the crankshaft, and determines a position of a crankshaft surface.

DETAILED DESCRIPTION

Figure 1:
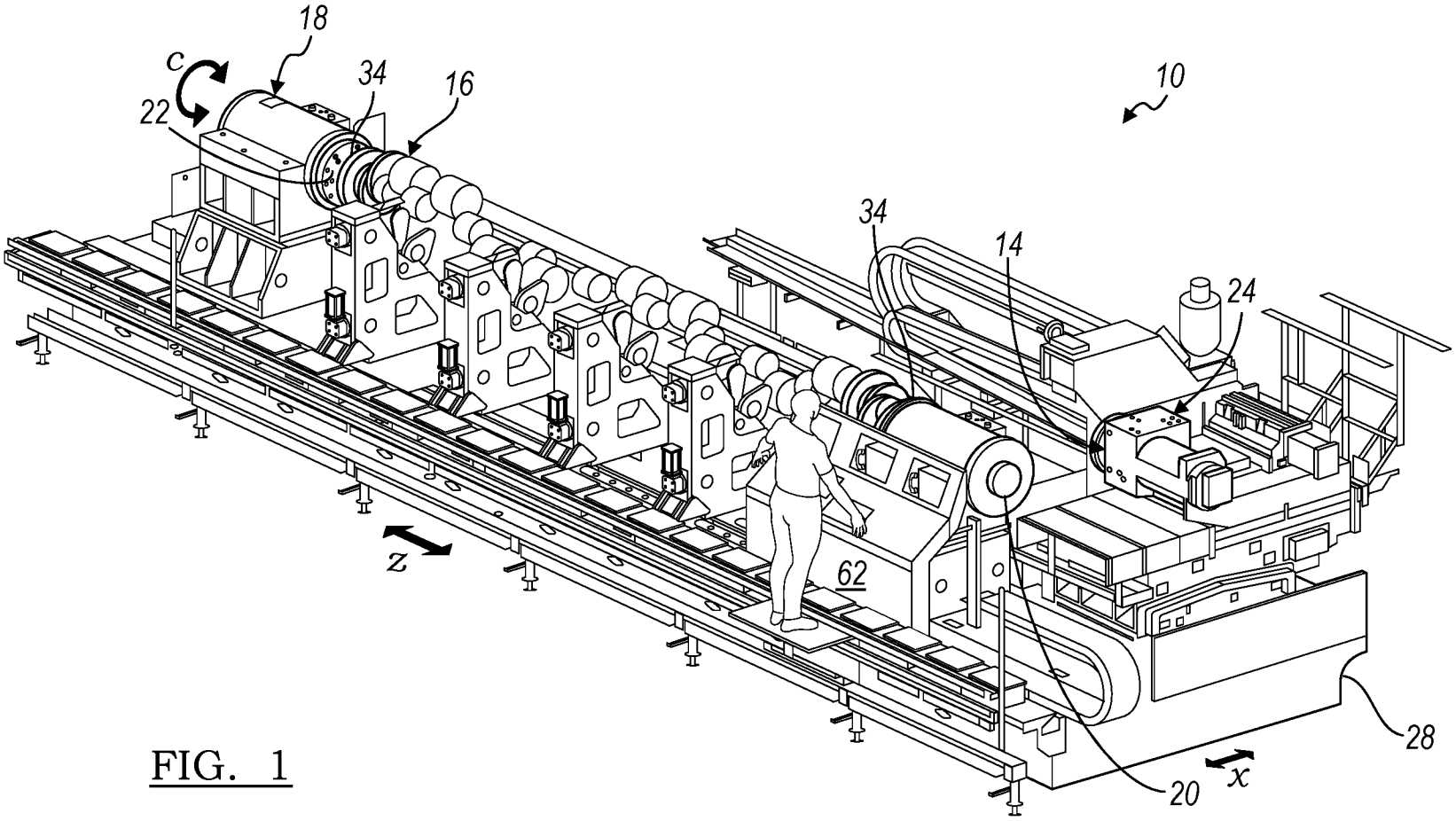
FIG. 1 is a perspective view depicting an implementation of a grinding machine having an acoustic emission sensor.
Figure 2:
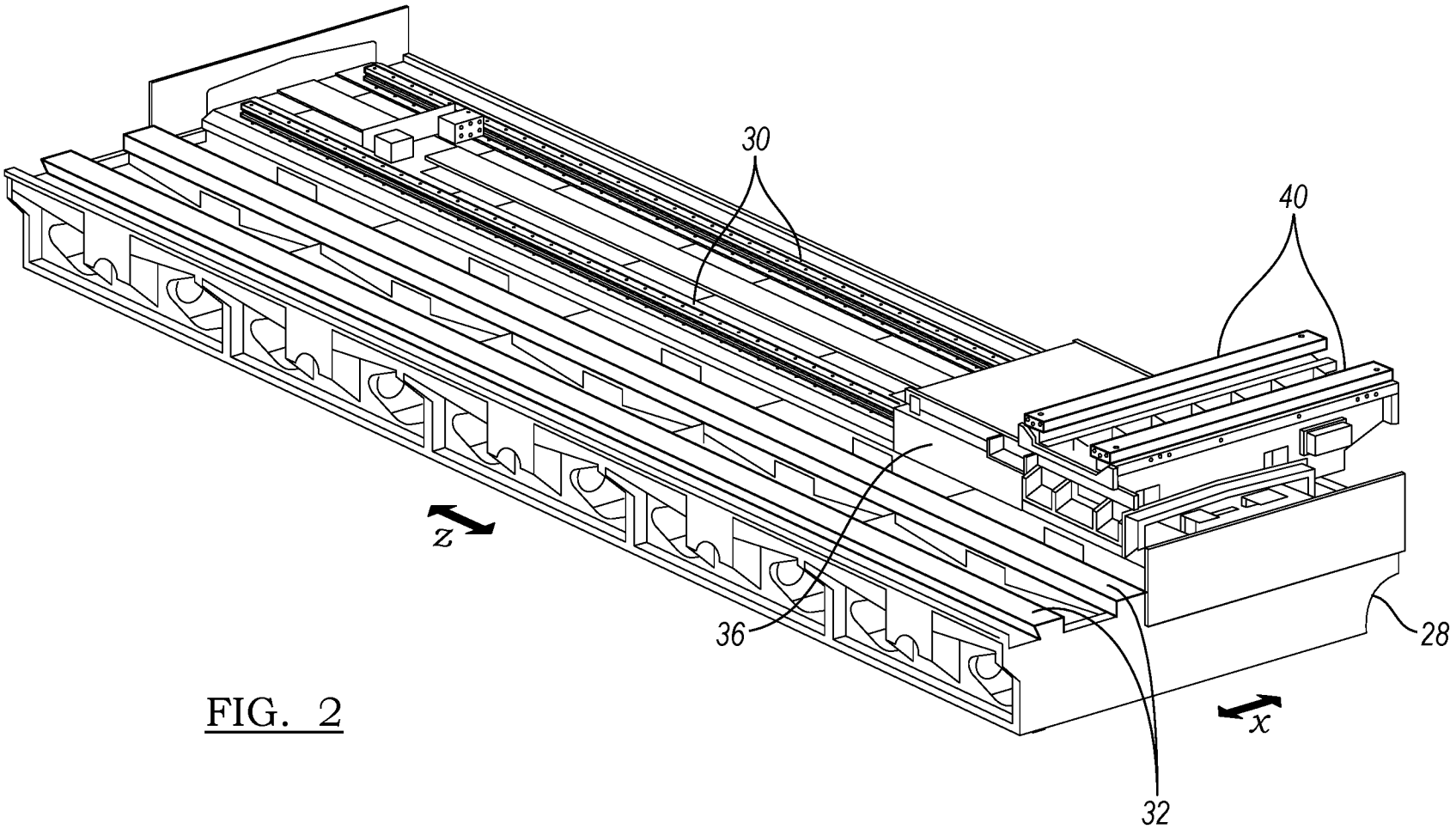
FIG. 2 is a perspective view depicting a portion of an implementation of a grinding machine having an acoustic emission sensor.
Figure 3:
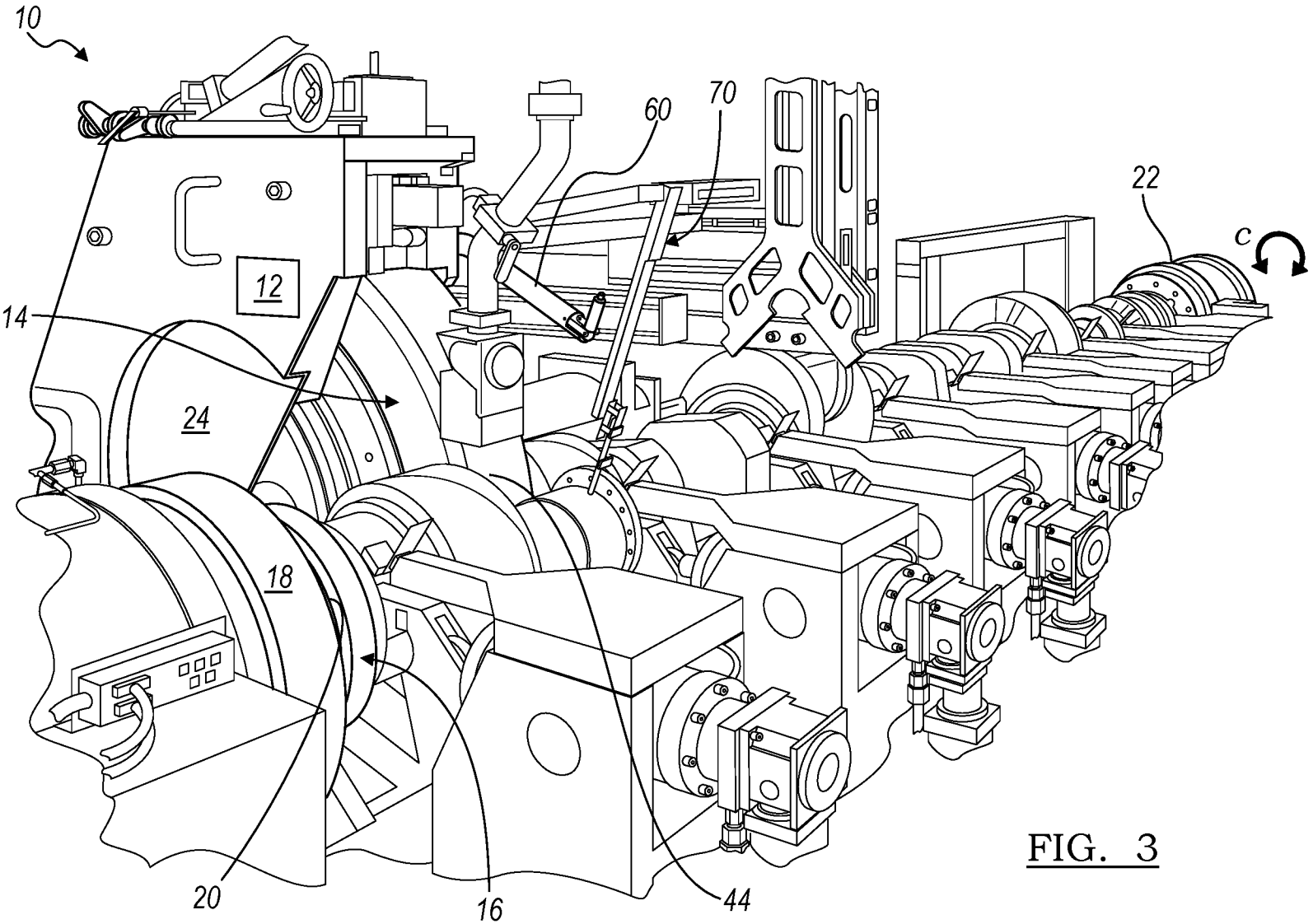
FIG. 3 is a perspective view depicting an implementation of a grinding machine having an acoustic emission sensor.
Figure 4:
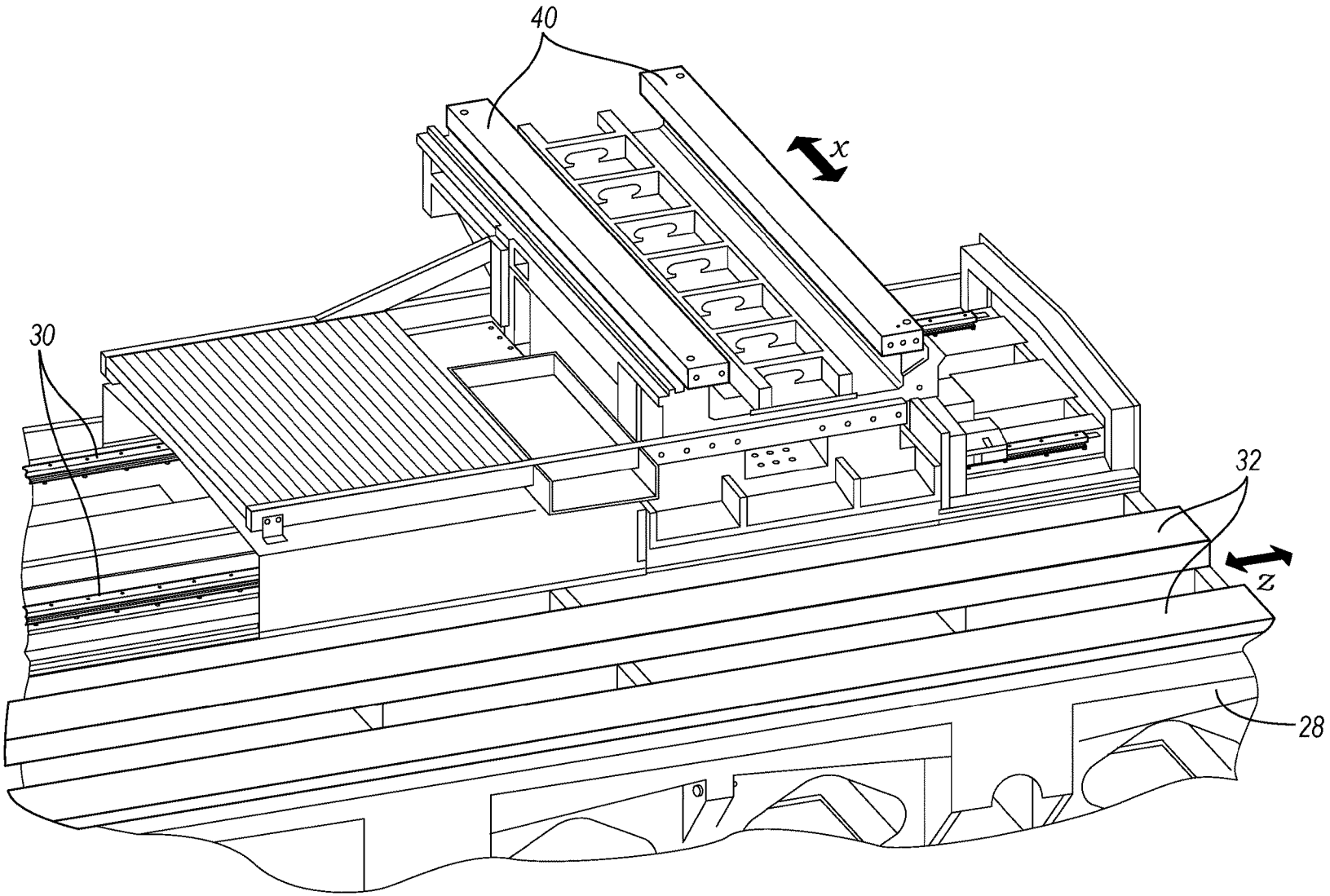
FIG. 4 is another perspective view depicting a portion of an implementation of a grinding machine having an acoustic emission sensor.
Figure 5:
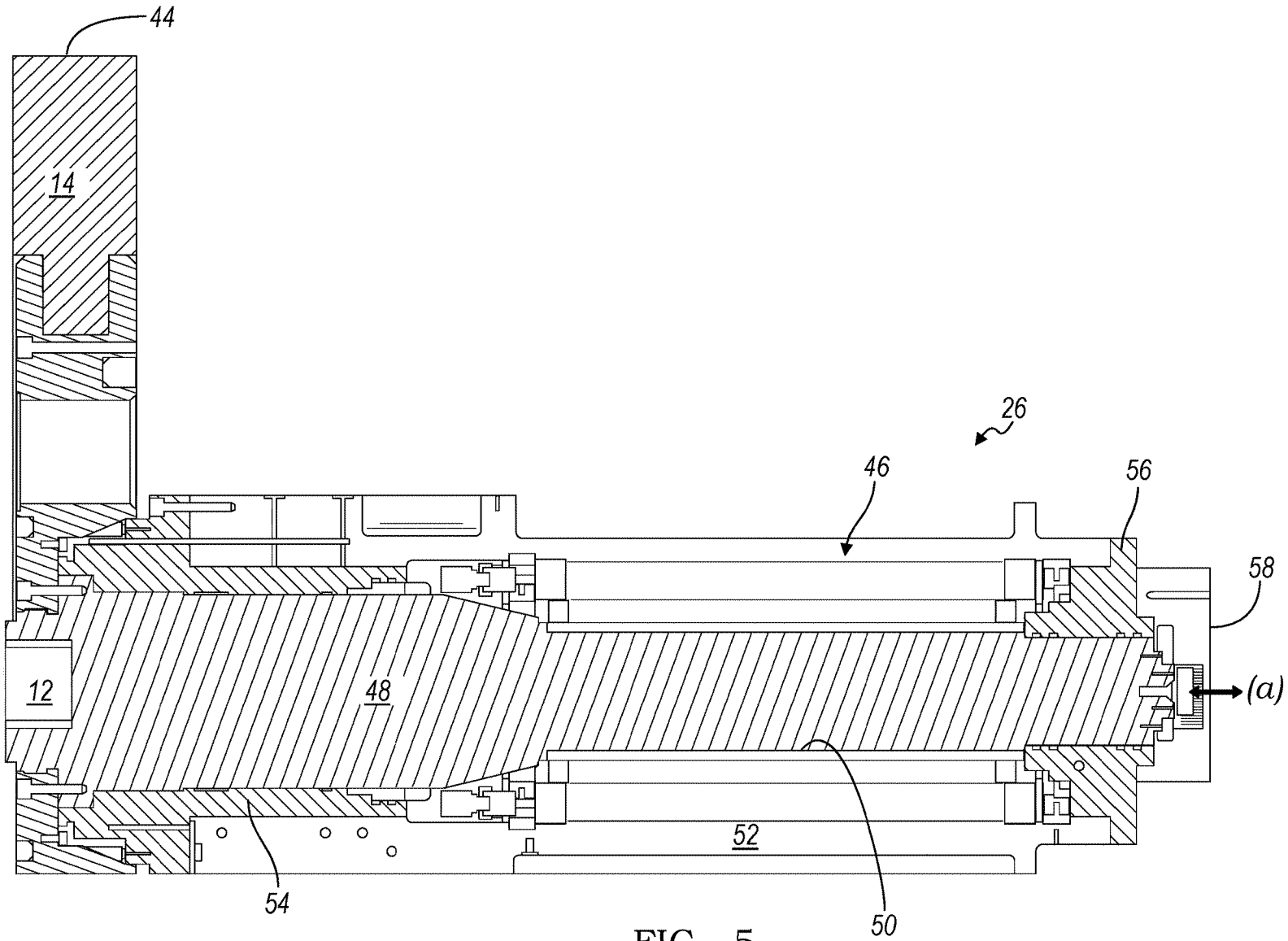
FIG. 5 is a cross-sectional view depicting a portion of an implementation of a grinding machine having an acoustic emission sensor.

A grinding machine uses acoustic detection to determine the location of a workpiece relative to a grinding wheel. In particular, an orbital grinding machine can include an acoustic emission sensor that acoustically detects when a grinding wheel is moved into contact with a workpiece surface, such as a crankpin or a journal bearing of a crankshaft before grinding begins. Dimensional tolerances of the workpiece surface can be reduced by acoustically detecting the location of the crankpin and/or journal bearing surfaces in the plane of operation, either alone or in combination with a physical probe. Before grinding begins, a grinding wheel can be moved into close proximity to the surface of the workpiece the grinding wheel will cut. The workpiece surface could be journal bearing surfaces or crankpins of a crankshaft. An acoustic emission sensor, such as a microphone, can be included with the grinding wheel, possibly at the wheel center or on a spindle assembly carrying the grinding wheel, and the grinding wheel can be moved toward the workpiece until the grinding wheel contacts the surface of the workpiece. The grinding machine can determine the position of the grinding wheel surface in space with tremendous precision. The acoustic emission sensor can detect the precise position of the spindle shaft carrying the grinding wheel when the grinding wheel contacts the surface of the workpiece by detecting the sound produced when contact occurs.

A computer processor can monitor the point where the grinding wheel contacts the surface of the workpiece.

In contrast, past grinding machines solely used a physical probe attached to the end of a carriage to locate the crankpins or journal bearings of a crankshaft in space. While the probes are highly accurate, a number of variables involved with grinding workpieces can introduce additional error into the probe measurement. For example, larger crankshafts (i.e., >1.5 meters) may tend to sag in the middle and also flex while machining or the grinding wheel can wear thereby reducing the distance between the wheel rotation axis about the spindle and the crankpins or journal bearing introducing error. Also, thermal variations can cause dimensional changes in the machine affecting overall accuracy of the probing process.

Presently, workpieces cut by grinding machines—such as crankshafts—can be hardened using one of a variety of different hardening techniques that leave a calculated thickness of hardening material. For example, crankshafts can be exposed to ammonia in a furnace that heats the crankshafts to nitride the surface. Currently, a crankshaft can receive ~0.1 mm of hardening material so that the errors in grinding will not unintentionally grind through the hardening material. But creating such a thickness of hardened material involves treating the crankshafts for a defined amount of time; thickness of hardening material on a crankshaft is positively correlated to time. It would be helpful to reduce the thickness of hardening material needed on the crankshaft thereby decreasing the amount of time spent applying hardening material. Determining the location of a journal bearing and/or a crankpin using an acoustic emission sensor before grinding can permit a reduced thickness of hardening material on the crankshaft. For example, it is possible to apply as little as 0.03 mm thick hardening material when using the acoustic emission sensor to detect journal bearing and/or crankpin location.

FIGS. 1-5 depict a grinding machine 10 that includes at least one acoustic emission sensor 12 that detects acoustic emissions occurring when a grinding wheel 14 is moved into contact with a workpiece. In this embodiment, the grinding machine 10 is an orbital grinding machine designed to grind outer surfaces of crankshaft workpieces. More specifically, the orbital grinding machine can create journal surfaces and crankpin surfaces on a crankshaft 16. In this implementation, the orbital grinding machine 10 can accommodate crankshafts small as 1.5 meters (m) and as long as 12 m. One implementation of such a grinding machine 10 is a Fives Landis LT3e orbital crankshaft grinding machine. However, other embodiments using different types of workpieces or grinding machines can use acoustic emission sensors to determine the position of a grinding wheel with respect to the workpiece.

The orbital grinding machine 10 can include a workpiece holder 18 having a headstock 20 and a footstock 22, a grinding wheel assembly 24 including a spindle assembly 26 coupled to the grinding wheel 14, and a machine bed 28. The machine bed 28 can be a relatively planar structure that rests on a floor and supports the elements of the grinding machine 10. For example, the machine bed 28 can support the headstock 20 and footstock 22 on a surface of the machine bed 28 so that the crankshaft 16 is engaged with both the headstock 20 and footstock 22 and raised above the bed 28. The machine bed 28 can be rectangular such that it is longer in length along a Z-axis than it is along a X-axis. One or more grinding wheel rails 30 can extend along the surface of the machine bed 28 along the Z-axis to facilitate movement of the grinding wheel assembly 24 along the Z-axis, such that the grinding wheel assembly 24 slides or rolls along the rails 30 in either direction to position the grinding wheel at a particular axial point along the X-axis. The grinding wheel assembly can be moved over the rails 30 along the Z-axis using a linear servo motor and optical scales can be used to identify the position of the grinding wheel 16 along the X-axis.

One or more workpiece holder rails 32 can be spaced apart from the grinding wheel rails 30, positioned opposite the grinding wheel rails 30 on the machine bed 28, extending along the Z-axis. The headstock 20 and the footstock 22 can slide or roll along the workpiece holder rails 32 to adjust for crankshafts having different axial lengths and engage a head of the crankshaft 16 and a tail of the crankshaft 16, respectively, with a workpiece holder 34, such as a chuck or collet, thereby holding the crankshaft 16 in a particular place. The workpiece holder 34 of the headstock 20 and the workpiece holder 34 of the footstock 22 can each include an electric motor that can, collectively in coordination, rotate the crankshaft 16 about its longitudinal axis (C) in a 360-degree range of motion in either angular direction. Rotary encoders can be used at the headstock 20 and at the footstock 22 to determine the angular position of the crankshaft 16. The headstock 20 and footstock 22 can each be individually moved along the Z-axis using servo motors and a rack drive.

The grinding wheel assembly 24 can include a base 36 that sits on the grinding wheel rails 30. The spindle assembly 26 can be supported by the base 36 so that it is moveable along the z-axis over the grinding wheel rails 30 and includes a grinding wheel 14 coupled to the spindle assembly 26, one or more infeed rails 40 in between the base 36 and the spindle assembly 26, a linear servo motor, an optical scale, and an acoustic emission sensor 12. The spindle assembly 26 can include a spindle drive motor 46 that turns a spindle shaft 48 ultimately rotating the grinding wheel 14 coupled to the spindle shaft 48. The grinding wheel 14 can have a radial surface 44 that contacts the crankshaft 16 and faces outwardly from an axis of spindle shaft rotation (a). The spindle drive motor 46 can be concentric with the spindle shaft 48, such that a rotor 50 of the spindle drive motor 46 is coupled with the spindle shaft 48 and a stator 52 is concentric with the rotor 50. Forward bearing 54 and rearward bearing 56 can be positioned on opposite ends of the spindle shaft 48 providing support during operation. The bearings 54, 56 can be implemented as hydrostatic bearings. A rotary encoder 58 can be attached to a distal end of the spindle shaft 48 for determining the angular position, velocity, or acceleration of the spindle shaft 48 and the grinding wheel 14. The infeed rails 40 can extend along the X-axis and be positioned perpendicularly relative to the grinding wheel rails 30.

The spindle assembly 26 can slide closer to and further away from the crankshaft 16 along the X-axis over the infeed rails 40. The linear motor can move the grinding wheel assembly 24 over the infeed rails 40 along the X-axis using an electric motor turning a linear actuator, such as a ball screw, and an encoder that identifies the position of the grinding wheel assembly 24 along the X-axis. The grinding wheel assembly 24 can also include a touch probe 60 that extends from the grinding wheel assembly 24 to contact the crankshaft 16 at particular locations and determine the distance between the grinding wheel assembly 24 and the crankshaft 16 with a high degree of precision. The touch probe 60 can determine the location of a surface of a crankshaft, such as a crankpin or journal bearings, alone with a precision ranging between 2.0 micrometers (μm) and 10.0 μm depending on such factors as probe repeatability, machine accuracy, including thermal variations of the grinding machine 10, and target surface finish of the crankshaft 16. A feeler gauge 70 can be attached to the grinding wheel assembly 24 and physically touch a crankpin to measure the dimensions of the crankpin. The feeler gauge 70 can be directed to extend from the assembly 24 to contact the crankpin surface and, as the crankshaft is rotated about the C-axis, the gauge 70 can measure the crankpin.

The acoustic emission sensor 12 can be carried by the grinding wheel assembly 24 and used to monitor sound created when the grinding wheel 14 contacts the crankshaft 16. The grinding wheel assembly 24 can include the acoustic emission sensor 12 in any one of a variety of locations. It can be helpful to position the acoustic emission sensor 12 as close to the grinding wheel 14 as possible to encourage a sufficient signal-to-noise ratio. For example, the acoustic emission sensor 12 can be fixed to an outer surface of the grinding wheel assembly 24 near the grinding wheel 14. The acoustic emission sensor 12 can be a microphone tuned to a particular frequency range. In one implementation, the acoustic emission sensor 12 can be tuned to detect audible emissions in a frequency range of 100-300 MHz. The acoustic emission sensor 12 can be a piezo-type acoustic emission microphone.

A computer processor 62 can provide input to and receive feedback from a number of components identified above. For example, the servo motors that control the movement of the machine bed 28 along the grinding wheel rails 30, the movement of the grinding wheel assembly 24 along the infeed rails 40, the operation of the spindle shaft 48, and/or the electric motors of the headstock 20 and the footstock 22 can all receive an input signal from the computer processor 62, such as a commanded motor speed and direction, and also provide an output signal to the computer processor 62, such as actual angular position, angular shaft speed, and/or angular direction. The acoustic emission sensor 12 can provide output to the computer processor 62 in the form of a signal indicating an absence or presence of sound or a strength of sound. The computer processor 62 can be any type of device capable of processing electronic instructions including microprocessors, microcontrollers, host processors, controllers, and application specific integrated circuits (ASICs). It can be a dedicated processor used only to carry out the described methods or can be shared with other functionality carried out by the grinding machine 10. The computer processor 62 executes various types of digitally-stored instructions, such as software or firmware programs stored in computer-readable memory. However, it should be appreciated that other implementations are possible in which at least some of these elements could be implemented together on a printed circuit board.

Figure 6:
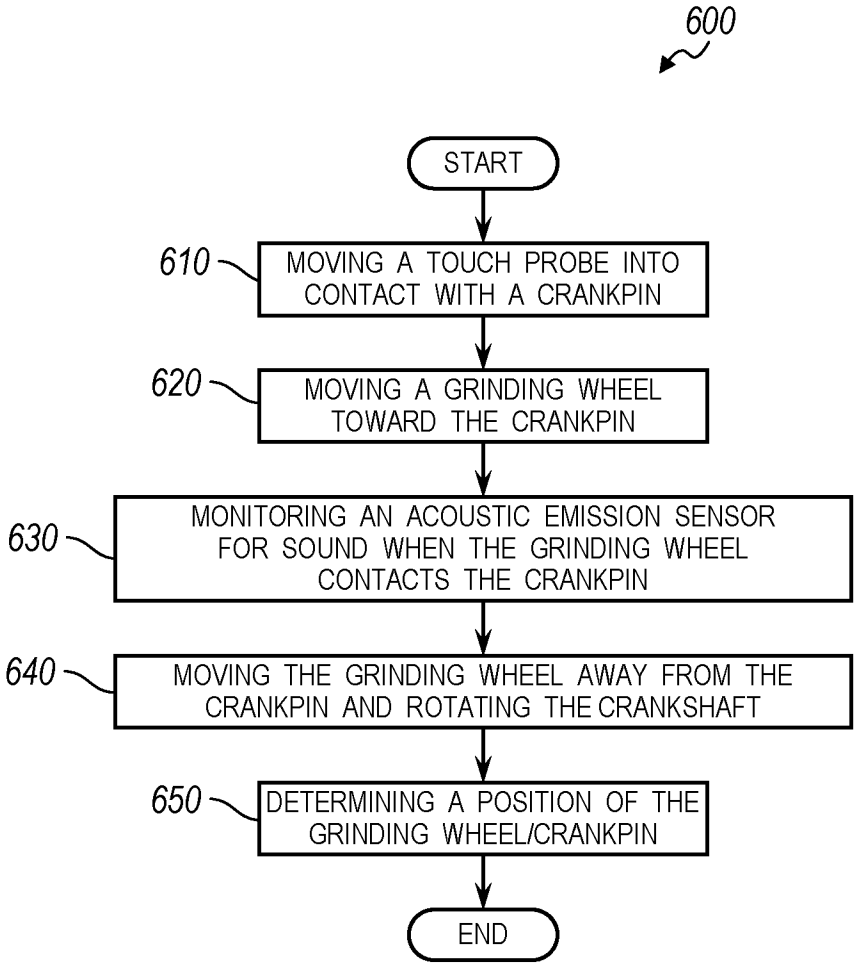
FIG. 6 is a flow chart depicting an implementation of a method of determining a grinding wheel position.

Turning now to FIG. 6, a method 600 of determining grinding wheel position is shown. The method 600 begins at step 610 by moving the touch probe 60 into contact with a crankshaft surface to determining an initial location position. The crankshaft surface for this embodiment of the method 600 will be described in terms of the crankpin of the crankshaft 16. However, other crankshaft or workpiece surfaces are possible. The grinding wheel assembly 24 can be moved along the Z-axis so that the radial surface 44 of the grinding wheel 14 used to process the crankpin, such as by grinding or mill turning, is aligned with the crankpin along the Z-axis. The headstock 20 and footstock 22 can rotate the crankshaft about the C-axis to ensure that the touch probe 60 would not strike a crankpin if the probe 60 were moved along the X-axis. The touch probe 60 can then be moved along the X-axis so that an end of the probe is within the circle of crankpin rotation about the C-axis. The headstock 20 and the footstock 22 can then rotate the crankshaft about the C-axis in a first rotational direction until the crankpin contacts the touch probe 60. A current angular position of the crankshaft 16 can be determined using the rotary encoders of the headstock 20 and the footstock 22. The computer processor 62 can then record the angular position where the crankpin touched the probe 60. The headstock 20 and footstock 22 can then rotate the crankshaft in the opposite rotational direction until the crankpin contacts the touch probe 60. The computer processor 62 can then record the angular position of the crankshaft when the crankpin contacts the touch probe the second time and determine the position of the crankpin and/or the grinding wheel assembly 24 based on the difference between the two contact angles. The data indicating the position of the crankpin surface based on the physical probe measurement can be recorded in a computer-readable medium, such as random-access memory (RAM), having read-write capability. The headstock 20 and footstock 22 can rotate the crankshaft 16 a defined angular amount away from the crankpin and the grinding wheel assembly 24 can retract from the crankshaft along the X-axis. The method 600 proceeds to step 620.

At step 620, the grinding wheel 14 is moved toward the crankshaft 16. If not already so positioned, the grinding wheel assembly 24 can be positioned so that the grinding wheel 14 is aligned with the crankpin along the z-axis such that motion of the assembly 24 along the X-axis will bring the grinding wheel 14 into contact with the crankpin. A current angular position of the crankshaft 16 can be determined using the rotary encoders of the headstock 20 and the footstock 22. The headstock 20 and footstock 22 can rotate the crankshaft to a first angular position. The first angular position can be any value, but in this implementation the first angular position is 0 degrees. The spindle assembly 26 can move toward the crankpin at a fast rate until the grinding wheel 14 approaches the crankpin. After the spindle assembly 26 is within a predetermined range of the crankpin, the assembly 26 can move toward the crankpin at a slow rate until the grinding wheel 14 contacts the crankpin. The method 600 proceeds to step 630.

At step 630, the acoustic emission sensor 12 is monitored for sound emitted when the grinding wheel 16 contacts the crankpin. As the spindle assembly 26 moves along the infeed rails 40 along the X-axis toward the crankpin, the computer processor 62 can activate the acoustic emission sensor 12 so that the sensor 12 detects the absence/presence of sound and/or the intensity of emitted sound. When the acoustic emission sensor 12 detects sound, an output signal can be sent from the acoustic emission sensor 12 to the computer processor 62. The computer processor 62 can then record the position of the grinding wheel assembly 24 in the X-Z plane when the assembly 24 contacts the crankpin at a first angular position (in this embodiment, zero degrees) based on the acoustic emission sensor 12 signal. The height of the grinding wheel 14 above the X-Z plane can be known or determined and the polar coordinates of the rotation axis (a) of the spindle 48 when the grinding wheel 14 contacts the crankpin can be determined. The data can be recorded in the computer-readable medium. In another implementation, the microprocessor 62 can monitor the electrical power consumed by the spindle drive motor 46 to determine when the grinding wheel 16 contacts the crankpin. As the spindle assembly 26 moves along the infeed rails 40 along the X-axis toward the crankpin, the computer processor 62 can monitor the electrical power consumed by the spindle drive motor 46 to detect a change in the electrical power. The change in electrical power can indicate when the grinding wheel assembly 24 contacts the crankpin. The method 600 proceeds to step 640.

At step 640, the grinding wheel 16 is moved away from the crankshaft and the crankshaft is rotated a defined angular amount about the C-axis. The headstock 20 and footstock 22 can rotate the crankshaft 16 a defined angular amount, such as 90 degrees, to a second angular position. The grinding wheel 14 can then be moved toward the crankpin as described with respect to step 620, the computer processor 62 can record the position of the grinding wheel assembly 24 in the X-Z plane when the grinding wheel 14 contacts the crankpin at a second angular position based on the acoustic emission sensor signal. The measurement of the crankpin surface has been rotated into different angular positions can be repeated and, in one implementation, can be measured at four positions-0 degrees, 90 degrees, 180 degrees, and 270 degrees. The measurements can be recorded in the computer-readable memory. In this implementation, the grinding wheel 14 contacts the crankpin at four angular positions. However, the quantity of angular positions at which the crankpin is contacted can be increased or decreased. For example, the quantity can be selected based on the condition of the crankpin surface. Crankpin surfaces that are less round or outside of specified dimensions by more than a determined amount can call for an increased quantity of angular positions at which the grinding wheel 14 is brought into contact with the crankpin whereas crankpin surfaces that are in better condition can involve fewer measurements. The method 600 proceeds to step 650.

At step 650, the computer processor 62 determines whether a sufficient number of measurements have been collected and, if so, determines a true position of the crankpin relative to the grinding wheel 14 based on the acoustic measurements. The position of the crankpin relative to the radial surface 44 of the grinding wheel can be determined using the acoustic sensor measurements at a plurality of angular positions. The throw and angle of the crankpin before grinding can be determined using one of a variety of techniques. In one implementation, the throw and angle can be determined by detecting the difference in positions where the grinding wheel touches the crankshaft surface at the two angles where the crankpin is most positive in the X plane and where the crankpin is most negative in the X plane (between 0-180 degrees) and determining an angle from the difference in positions where the grinding wheel touches the part with the crankpin up and with the crankpin down (90 and 270 degrees). In another implementation, the location of the rough crankpin surface can be calculated using a regression technique, such as a least squares circle fit as described in British Standards (BS) 3730-2:1982. In applying the least squares circle fit, grinding wheel contact positions can be interpreted using the axis path described in EP1235662 assigned to Landis, the contents of which are incorporated by reference. Measurements of the crankpin relative to the grinding wheel 14 based on an output signal from acoustic emission sensor 12 can compensate for current thermal distortion of the grinding machine 10 as well as a changing radius of the grinding wheel 14 due to previously-carried-out grinding. The method 600 then ends.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A grinding machine including one or more grinding wheels, comprising:

a workpiece holder that releasably holds a crankshaft and is configured to rotate the crankshaft about a longitudinal axis;

a spindle assembly, that is moveable in at least two directions, including a spindle shaft and a grinding wheel of the one or more grinding wheels attached to the spindle shaft; and an acoustic emission sensor coupled to the grinding machine, wherein the grinding machine is configured to monitor an output signal from the acoustic emission sensor, move the grinding wheel into contact with the crankshaft at a first angular position, detect contact between the grinding wheel and the crankshaft based on the output signal, determine a first position of the grinding wheel based on the detected contact between the grinding wheel and the crankshaft, move the grinding wheel away from the crankshaft, rotate the workpiece holder and the crankshaft a defined angular amount between the first angular position and a second angular position, move the grinding wheel into contact with the crankshaft at the second angular position, determine a second position of the grinding wheel based on the detected contact between the grinding wheel and the crankshaft, and determine a position of a crankshaft surface.

2. The grinding machine recited in claim 1, wherein the acoustic emission sensor is a microphone.

3. The grinding machine recited in claim 1, wherein the acoustic emission sensor is coupled to an exterior surface of the grinding machine.

4. The grinding machine recited in claim 1, further comprising a touch probe.

5. The grinding machine recited in claim 1, further comprising a feeler gauge.

6. The grinding machine recited in claim 1, wherein the workpiece holder comprises a headstock and a footstock.

7. A method of determining a grinding wheel position, the steps comprise:

(a) determining an angular position of a crankshaft held by a workpiece holder;

(b) moving a grinding wheel coupled with a spindle shaft toward the crankshaft;

(c) monitoring an acoustic emission sensor as the grinding wheel moves toward the crankshaft before grinding begins;

(d) detecting when the grinding wheel contacts the crankshaft based on output from the acoustic emission sensor;

(e) moving the grinding wheel away from the crankshaft;

(f) rotating the workpiece holder and the crankshaft a defined angular amount from a first angular position to a second angular position;

(g) moving the grinding wheel toward the crankshaft at the second angular position;

(h) monitoring the acoustic emission sensor as the grinding wheel moves toward the crankshaft at the second angular position before grinding begins;

(i) detecting when the grinding wheel contacts the crankshaft at the second angular position based on output from the acoustic emission sensor;

(j) determining a position of the grinding wheel based on steps (d) and (i).

8. The method of claim 7, further comprising the steps of: moving a touch probe into contact with the workpiece before moving the grinding wheel into contact with the workpiece.

9. The method of claim 8, wherein the touch probe contacts the workpiece at a plurality of angular positions.

10. A grinding machine including one or more grinding wheels, comprising:

a workpiece holder that releasably holds a crankshaft and is configured to rotate the crankshaft about a longitudinal axis;

a spindle assembly, that is moveable in at least two directions, including a spindle shaft and a grinding wheel of the one or more grinding wheels attached to the spindle shaft; and a microprocessor configured to measure electrical power consumed by a spindle drive motor, wherein the grinding machine moves the grinding wheel into contact with the crankshaft at a first angular position, detects contact between the grinding wheel and the crankshaft based on a change in the electrical power consumed by the spindle drive motor, determines a first position of the grinding wheel based on the detected contact between the grinding wheel and the crankshaft, moves the grinding wheel away from the crankshaft, rotates the workpiece holder and the crankshaft a defined angular amount from the first angular position to a second angular position, moves the grinding wheel into contact with the crankshaft at the second angular position, determines a second position of the grinding wheel based on the detected contact between the grinding wheel and the crankshaft, and determines a position of a crankshaft surface.

11. The grinding machine recited in claim 10, further comprising a touch probe.

12. The grinding machine recited in claim 10, further comprising a feeler gauge.

13. The grinding machine recited in claim 10, wherein the workpiece holder comprises a headstock and a footstock.

14. The grinding machine recited in claim 10, wherein the microprocessor detects an increase in electrical power.

* * * * *